United States Patent [19]

Valbuena

[11] Patent Number: 4,747,169

[45] Date of Patent: May 31, 1988

[54] PORTABLE SINK WITH PRESSURIZED WATER SUPPLY

[76] Inventor: Rene F. Valbuena, 23235 Sky Dr., El Toro, Calif. 92630

[21] Appl. No.: 889,770

[22] Filed: Jul. 28, 1986

[51] Int. Cl.[4] ..... A47K 1/00

[52] U.S. Cl. ..... 4/625; 4/638; 4/642

[58] Field of Search ..... 4/625–628, 4/638, 642, 643, 653, 602, 603, 616, 630; 251/149.6; 128/203.12

[56] References Cited

U.S. PATENT DOCUMENTS

| | | | |
|---|---|---|---|
| 734,348 | 7/1903 | Muehl | 4/626 |
| 1,374,778 | 4/1921 | Terry | 4/626 |
| 2,334,293 | 11/1943 | Stein | 4/642 |
| 2,594,938 | 4/1952 | Leavitt | 4/626 |
| 2,944,862 | 7/1960 | Heil | 4/625 X |
| 3,579,656 | 5/1971 | Guarrasi | 4/626 X |
| 3,773,065 | 11/1973 | Mattox | 137/263 |
| 3,983,583 | 10/1976 | Herman et al. | 4/638 X |
| 4,058,120 | 11/1977 | Caparrelli et al. | 128/203.12 |
| 4,091,475 | 5/1978 | Hewson et al. | 4/321 |
| 4,130,123 | 12/1978 | Wines et al. | 4/626 X |

*Primary Examiner*—Charles E. Phillips

*Attorney, Agent, or Firm*—Paul H. Gallagher

[57] ABSTRACT

The portable sink includes a main case having an open top and a hinged cover. In place in the main case is an inside case and a sink bowl unit. A supply tank is removably fitted in the inside case. The supply tank is generally closed, but having a filling opening and openings for conduits for admitting compressed air thereto and explusion of water therefrom. In response to placing the supply tank in the inside case, connections are automatically made for controlling a flow of air from a supply of compressed air into the tank. The sink bowl unit has two bowls, one of which is higher than the other, enabling water to run from the higher one to the lower one, and an outlet is provided in the lower sink bowl into a waste tank which is detachably secured in the assembly. A hose is connected to the outlet of the tank to enable the user to direct the water expelled from the tank into the sink bowl, or to other points of use. A detergent container is provided for selective inclusion of detergent in the outlet water stream. The device enables the user to remove the supply tank and carry it to a main water supply, and fill the tank and carry it back to the device, and upon assembling the components, the water is expelled and used as an ordinary running water system.

9 Claims, 3 Drawing Sheets

PORTABLE SINK WITH PRESSURIZED WATER SUPPLY

FIELD OF THE INVENTION

The invention has particular adapatability to camping activities. Providing water in camp sites, where no running water supply is present, is quite primitive and somewhat troublesome, and correspondingly undesirable. In such cases, water is usually carried in pails to the point of use, and after that step, performing the washing steps, and related steps, are laborious and unsatisfactory. Such supply at the site also is limited, with consequent inconveniences.

OBJECTS OF THE INVENTION

A broad object of the invention is to provide a novel portable sink having the following features and advantages:

1. The device includes a sink assembly or structure having a sink bowl, and having a carrying tank, or supply tank therein that is removable for carrying water from a water supply to the sink assembly, and placeable in the structure for use of the water therein, in the sink bowl.

2. The supply tank with the water therein provides a relatively large supply for repeated and continued use in the sink bowl.

3. Novel means is included for automatically connecting various components in the device in response to placing the filled tank in the sink assembly, and for conveniently connecting other components.

4. Compressed gas means is included in the device for forcing the water from the tank to the point of use, thus providing running water, such as in the sink bowl, or at a point external to the sink assembly, selectively.

5. Means is included for supplying detergent in the water for washing or shutting off the detergent for providing clear water, for rinsing, selectively.

6. Safety means is provided for preventing tampering by children.

DESCRIPTION OF A PREFERRED EMBODIMENT

Referring to the invention in general, the device, designed for a camping site, is used for carrying a supply of water from a distance to the site, and provides a supply of water that can be used for a relatively long period; moreover, the water is pressurized and the device is capable of being used in substantially the same manner in which a normal domestic supply of running water is used in the home. The water is supplied through an outlet conduit or hose, and the flow of the water through the conduit is controlled by a simple manually controlled valve.

Figure 1:
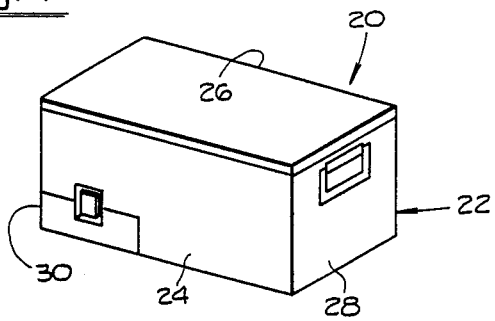
FIG. 1 is a perspective view of a portable sink made according to the present invention.
Figure 2:
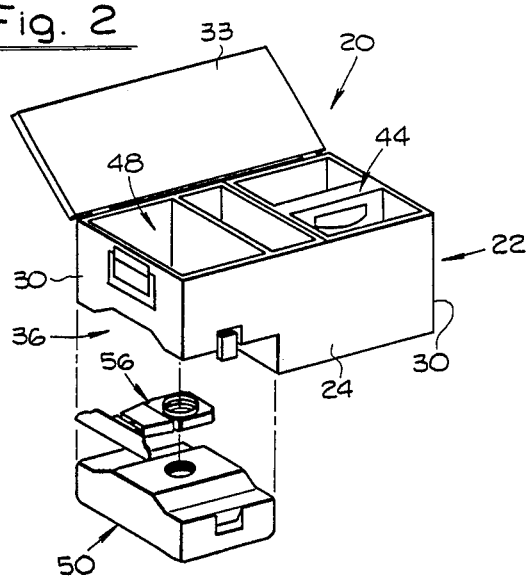
FIG. 2 is a perspective view, from the opposite direction of FIG. 1, showing the portable sink with the cover open and one of the main components in detached position.

Referring in detail to the drawings, FIG. 1 is a perspective view of the device of the invention, indicated in its entirety at 20, in closed position for carrying. The device is shown in FIG. 2 with the cover open and one of the main components separated from the remainder of the device.

The entire device in assembled and closed position, may be similar to an ordinary cooler chest, and may for example be in the neighborhood of 38 inches long. Such dimension of course is only an example and is not to be limiting, since the device may be of any size desired, preferably of course within the limits of portability. The various parts of the device may be of any suitable material, preferably metal, such as stainless steel, and of course other materials, where appropriate, such as in the case of seals, etc.

The device includes a main outer case 22 which may be similar to a commonly known cooler chest. For convenience, the device is referred to as having a front side 24, a rear side 26, a right end 28, and a left end 30.

Figure 3:
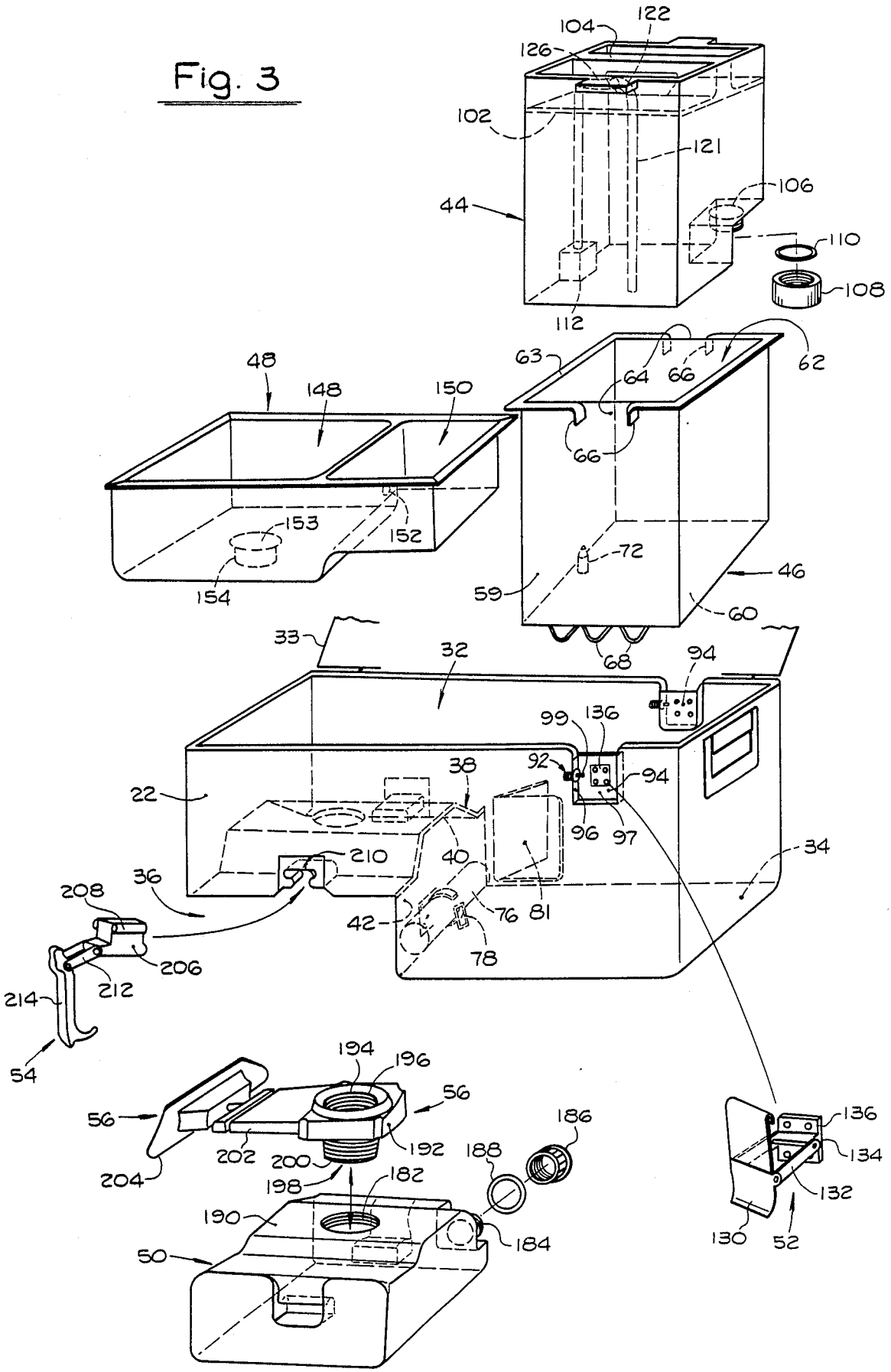
FIG. 3 is an exploded view of the parts of the portable sink.

Attention is directed to FIG. 3 for the constructional features of the device, and in this figure, the case 22 is shown near the center. The main case 22 has an open top 32 closed by a cover 33, a panel 34 forming a bottom element or floor at one end, and it has a cut out portion or void 36 at the other end. The case at the latter end is provided with a bottom element 38 which is elevated relative to the bottom element 34 and has a raised center portion 40. A wall element 42 closes the corresponding part of the case, i.e. it interconnects the bottom elements 34 and 38. Other features are included in the case, as will be referred to hereinbelow.

Other main components making up the entire device, include a carrying tank or supply tank 44, an inner case 46, a sink bowl unit 48, and a holding tank or waste tank 50. Also shown in FIG. 3 is a clasp 52, two of which are included, which may be fixedly secured to the main case 22. Other components of the device include a clasp 54, two of which are provided, detachably applied to the main case for mounting the holding tank 50. Another component includes a valve 56 for shutting off the flow of water from the sink bowl unit. Still another main component is a water outlet nozzle 58 (FIG. 15) which includes a brush, and is sometimes referred to as a brush.

Figure 4:
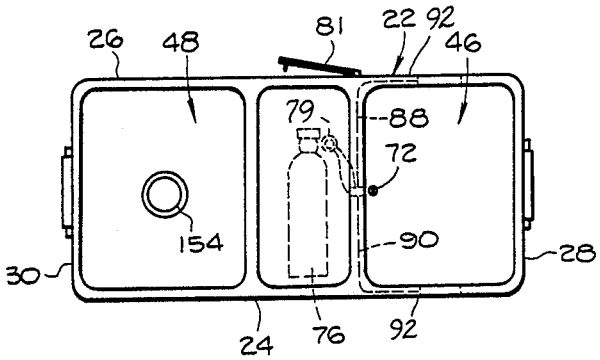
FIG. 4 is a top view of the device, with the cover open.
Figure 7:
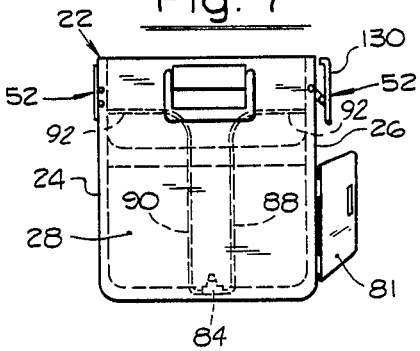
FIG. 7 is a view from the right end.

In the assembly of the components, the inside case 46 is placed in the main case 22 at the right end thereof (FIGS. 4, 5, and 6) and the sink bowl unit 48 is likewise positioned in the main case, at the left end thereof.

The inside case 46 is in the form of a container, having side walls 59 and a bottom element 60 and having an open top 62. The open top is provided with a horizontal flange 63 surrounding most of the case, but having ends spaced apart forming spaces 64 at the ends of the case, by downturned tabs 66. Ribs 68 are provided on the bottom element 60 (FIGS. 3 and 14) to form a space 70 for accommodating various elements of the device as referred to hereinbelow. Mounted in the inside case is a nozzle 72 which cooperates with a valve in the supply tank 44 when the components are assembled as will be referred to hereinbelow.

Figure 5:
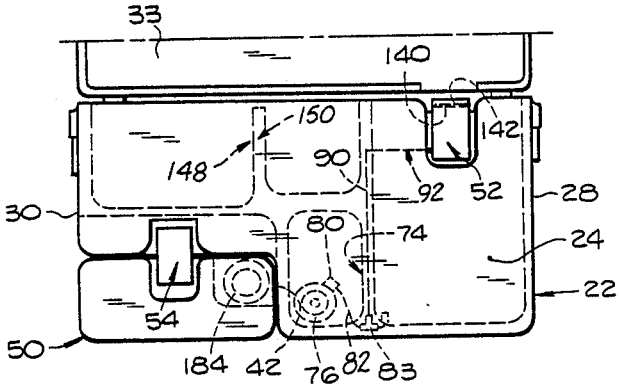
FIG. 5 is a front view.
Figure 6:
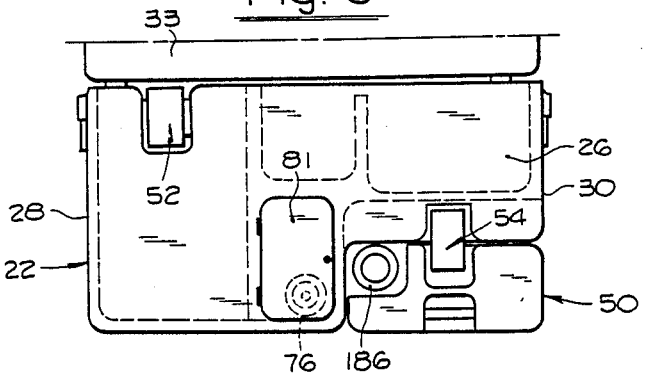
FIG. 6 is a rear view.

As referred to above, a supply of compressed gas is provided, and it becomes active in response to the components of the device being assembled. Reference is made to that supply of compressed gas at this point to facilitate description of the assembly of the other components. As seen in FIG. 5, there is a space indicated at 74. This space is utilized for mounting the supply of compressed gas, and such supply is provided by a known kind of bottle 76, which is mounted in place by means of a gripper 78 (FIG. 3). The bottle may have a supply of air at 300 psi and a shut off and control valve 80 limiting the flow of air to, for example, 30–40 psi. An outlet conduit 82 leads from that valve to the supply tank, through various fittings. A door 81 is provided on the rear side of the main case for gaining access to the space 74, for insertion and removal of the compressed air bottle 76, and for access to a manual shut off valve 79 on the bottle.

Figure 11:
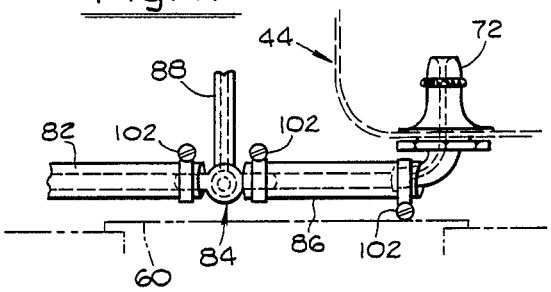
FIG. 11 is a detail view of certain parts of connector elements for the gas pressure feature.
Figure 12:
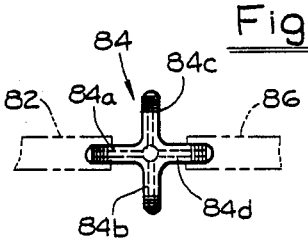
FIG. 12 is a detail view of a cross connector incorporated in FIG. 11.

Reference is now made to the various elements for conducting the compressed air to the supply tank, and the means for controlling that flow. The outlet conduit 82 leads to a cross connector 84 (FIGS. 5 and 12) which has a plurality of short conduits 84 individually identified 84*a*, 84*b*, 84*c*, 84*d*. This cross connector is located at the bottom of the main case adjacent the space 70 (FIG. 14) and the conduit 82 is connected to one of the conduits 84, e.g. 84*a*. Another conduit 86 leads from the branch 84*d* to the nozzle 72 (FIG. 11).

Figure 10:
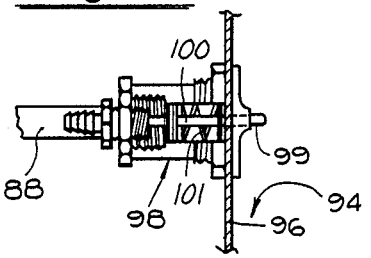
FIG. 10 is a large scale sectional detail view of a valve shown in FIG. 7.

Additional conduits 88, 90, lead upwardly from the conduits 84*c*, 84*d* (FIGS. 4, 5, 7, 11) and terminate at points 92 (see also FIG. 3) in a construction described hereinbelow. In connection with the conduits 88 and 90, the main case 22 (see particularly FIG. 3) is provided with recesses 94 adjacent the top, at front and back, and opening outwardly and upwardly. These recesses have bounding wall elements 96 on the sides and bottom and an inner wall 97. The conduits 88 and 90 open through the corresponding side wall elements 96 into these recesses at the points 92 mentioned. These conduits have automatic lock units 98 (FIGS. 3 and 10) at their extended ends. Each lock unit has a pin 99 extended through the side wall 96 into the respective recess 94, the pins being on pistons 100 biased to retracted position by compression springs 101, and moved to extended position by the compressed air in the conduits.

The conduits 82, 86, and other conduits, may be secured in place by suitable clamps 102 (FIG. 11) which may be manually manipulated. The conduits 88, 90, lead up to their terminal points 92 through the spaces between the components, such as along the surfaces of the inside case 46. The inside case 46 is put in the main case 22 and may remain there indefinitely, not necessarily being removed at particular camping sites. It is put in place in the main case merely by setting it therein, and is held in place in front-rear direction by engagement with the corresponding side walls of the main case, and is held in position against movement longitudinally of the main case, to the left as viewed in FIGS. 3–5, by engagement of the tabs 66 with the side walls 96 of the recesses 94.

The inside case 46 solidifies the assembly with respect to the supply tank, and absorbing shock in placing the supply tank in position and removing it therefrom. In the use of the device, the supply tank is fitted in the inside case 46 in the assembly.

Referring to the specific structure of the supply tank 44, this tank is generally closed and reference thereto is as oriented in FIG. 3. It includes a top closure element 102 with a handle 104. It has a bottom opening 106 for filling the tank, which is closed by a detachable cap 108 having a sealing ring 110.

Figure 14:
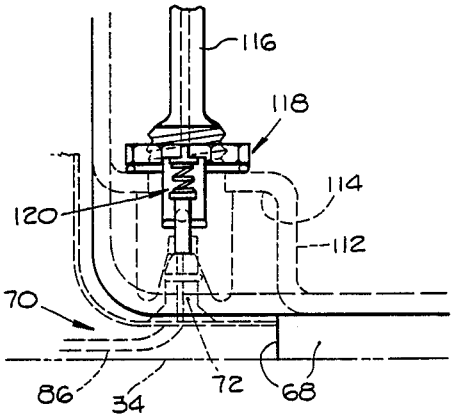
FIG. 14 is a view of the vertical air pipe in cooperation with the tank.

The tank has, at one side, an offset member 112 (FIG. 3) forming a recess 114 thereunder (FIG. 14). A vertical air pipe 116 is mounted on the member 112 by suitable connector means 118, and rises to a point adjacent to the top where it opens in the interior of the tank. The fitting 118 includes a check valve 120, of known kind, biased to normally closed position. When the supply tank 44 is inserted into the inside case 46, the fitting 118 fits onto the nozzle 72, which automatically opens the check valve 120 in response to that movement.

Figure 13:
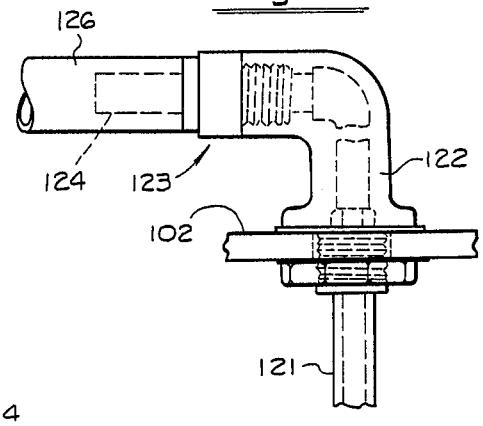
FIG. 13 is a large scale detail view of a connector in the water delivery conduit.

The supply tank 44 includes a vertical outlet water delivery pipe 121 (FIGS. 3 and 13) having an open lower end adjacent to, but spaced from, the bottom of the tank, and leading through the top wall where it is connected with an elbow 122 in which a fitting 123 is connected. The fitting 123 has an extension 124 on which a flexible hose 126 is releasably fitted, this hose leading to a point of use as will be referred to again hereinbelow.

The clasps 52 (FIGS. 5, 7, 9) identified above, releasably secure the supply tank 44 in the assembly. Each clasp includes a plate 130 pivoted at 131 on links 132, the links being pivoted at 134 on a plate 136 and the plate is fixedly secured to the inner wall 97 of the recess 94 in the main case. Each plate 130 has a downwardly extending hook 140 at the top which engages an upwardly extending hook 142 (FIG. 5) on the inside case.

To operate the clasps, after the supply tank is put in place, the plates 130 are actuated to interengage the hooks 140, 142, and then the plate is pushed downwardly and inwardly into locking position, in a known manner. The plates are provided with extensions 144 adjacent the bottom, having holes 146 into which the pins 99 extend. In putting the supply tank 44 in place, and locking the clasps 52, when no air under pressure exists in the conduits, the pins 99 are retracted by the movement of the plates 130, and they then enter the holes 146. Later, when air under pressure is introduced into the conduits, the pins are pressed outwardly in locking position and held there, locking the clasps against opening.

The sink bowl unit 48 (FIGS. 3, 5) preferably includes two bowls, a deeper bowl or main bowl 148 and a shallower bowl or secondary bowl 150, having a closable drain hole 152 therebetween. The sink bowl unit 48 is of appropriate length to extend between the end wall of the main case and the inside case. The sink bowl unit rests on the bottom wall element 38 of the main case, and the shallower bowl 150 is disposed above the space 74 (FIG. 5) defining that space at the top. The main sink bowl 148 has a bottom drain hole 153 which may be surrounded by a downwardly extending tubular element 154.

In the supply tank, the filler opening 106 is placed at the bottom rather than at the top, as a safety feature.

When the supply tank is fitted in place in the inside case, the filler opening is inaccessible, preventing children from removing the cap.

Figure 15:
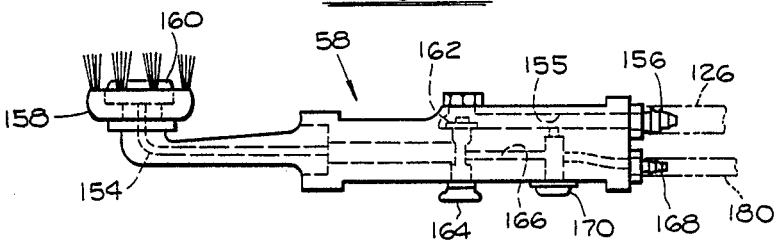
FIG. 15 is a view of a nozzle means or brush to be mounted on the water delivery conduit.

The water is delivered from the supply tank by means of the outlet nozzle unit 58 identified above (FIG. 15). This nozzle unit is of known type, having a main air passage 155 and having a fitting 156 to which the outlet conduit 126 (FIG. 13) is connected, leading from the supply tank. The air conduit 155 leads through the nozzle unit having an outlet portion 154 and having a brush member 158, which may be detachably secured to the main portion of the unit by means of a cap 160, the cap also enabling the flow of water therethrough.

The flow of air through the main passage 155 is controlled by a valve 162 opened and closed by a manually actuated push button 164.

Figure 16:
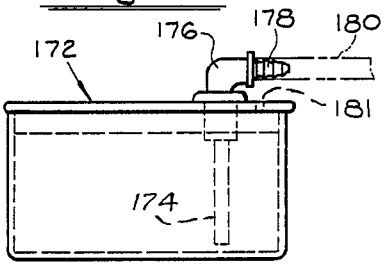
FIG. 16 is a view of a container for detergent.

The nozzle unit 58 also includes the second fluid passage 166 leading from an external fitting 168. The secondary passage 166 leads into the main passage 155 and is set to open and closed positions by a manually actuated cock 170. When the cock is set in open position, and the push button 164 is depressed, opening the valve 162, the water flowing through the main passage 155 produces an inspirator effect, drawing fluid from the passage 166. This passage is for withdrawing detergent or soap from a container or tank 172 (FIG. 16) having a vertical outlet pipe 174 therein having an open lower end adjacent to but spaced from the bottom of the container and leading through the top wall where an elbow 176 is connected, the elbow having a fitting 178. A conduit 180 is fitted on the fitting 178, and the fitting 168 of the nozzle unit 58. An air relief vent 181 is provided in the tank.

When the user wishes to use the device, he sets the cock 170 to closed or open position as desired, and upon despression of the push button 164, water flows from the supply tank through the nozzle means to the selected point of use. If the cock 170 is open, detergent flows with the water, and if it is closed, clear or rinse water is provided. The water is then directed to the point of use, to either of the sink bowls 148, 150, or to another external location.

Figure 8:
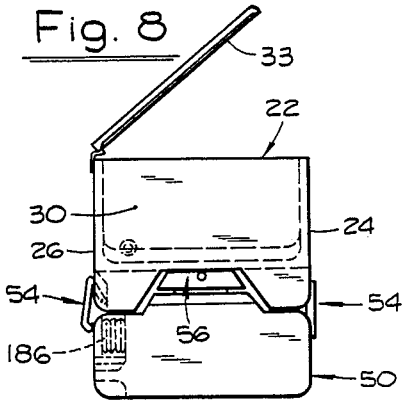
FIG. 8 is a view from the left end.

As indicated above, the holding tank or waste tank 50 (FIGS. 3, 5, 8) is utilized for receiving waste water from the sink bowls. The holding tank 50 is generally closed, but has a top opening 182. It also has another opening 184 normally closed by a cap 186 with a sealing ring 188.

The top of the waste tank 50 indicated at 190, and the bottom wall element 38 of the main tank, are so shaped and dimensioned (FIG. 8) to accommodate the shut off valve member 56 identified above. This valve member includes a housing 192 having an opening 194 for receiving the waste water from the sink, a sealing ring 196 being provided. The housing 192 also has a bottom opening 198 surrounded by a tubular element 200, for extending into the top opening 182 in the waste tank. A sealing ring in this location may also be used.

The valve member 56 includes a shut off plate 202, having a handle 204, slidably mounted in the housing 192 and shiftable between a retracted or open position shown in FIG. 3, and a closed or shut off position, to the right relative to the position of FIG. 3, for shutting off the flow of water from the sink bowls into the waste tank. This shut off step is performed in the normal use of the sink bowls.

The waste tank, as indicated above, in the assembly of the entire device, fits in the void 36 and is held therein by clasps 54, one of which is shown in FIG. 3. These clasps are located for example at front and rear of the device, and each clasp includes a block 206 having lateral ribs 208 adjacent the top which removably fit in grooves 210. Pivotally mounted on the blocks 206 are links 212, the links supporting a hook 214. Upon insertion of the waste tank into position in the void 36, the clasps 54 are put in place, and clasped or locked under the waste tank to hold it in position.

It will be noted that the waste tank is is line vertically with the sink unit, but to avoid having two such components in alignment which would otherwise necessitate removing an outer one in order to remove the inner one, the provision in the present construction in which one of the components (the sink bowl unit) is inside the main case and the other component (waste tank) is mounted externally to the main case, eliminates the disadvantage referred to above in connection with aligned components. The waste tank is dimensioned for filling the void, thus presenting an overall generally regularly shaped case or box.

The device may be provided with suitable handle means, either in the form of a pair of handle members, or a single bail, for example, to facilitate carrying the overall device.

The outlet nozzle 58, and the detergent container 172, together with the conduit 180, may be considered a separate component, readily detachable from the remainder of the device. The container 172 may be placed in any convenient location, such as on the supply tank.

Figure 9:
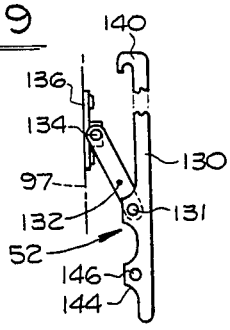
FIG. 9 is a large scale detail view of a clasp shown in FIG. 7.

In the practical use of the device, at a starting point, the supply of compressed gas is in shut off condition. The user then removes the supply tank 44, and in this step the hose 126 (FIGS. 3 and 13) is detached from the tank; he then fills it and returns it to the assembly and puts it in position in the inside case and replaces the hose 126. In so positioning the tank, the control unit at the bottom of the tank forms a communication with the supply conduit 86. He moves the clasps 52 to locking position, and this effects the entrance of the locking pins 99 in the holes 146 (FIG. 9). He then reaches in through the door 81 and opens the shut off valve of the pressurized gas supply. This results in the compressed gas (air) into the supply tank and forces it out through the outlet pipe 121 and the water conduit 126 to the outlet nozzle 58 and thereafter the water is used as described above. Upon depletion of the water from the tank, the air pressure is held by the closure of the outlet nozzle 58. At this point, when it is desired to provide a new supply of water, the user shuts off the shut off valve in the pressurized gas supply. The user may then open the outlet nozzle 58 and enable escape of the air in the tank, and at that point the tank can be removed. In removing the tank, the clasps 52 are of course unlocked, and the absence of air pressure from the conduits 88, 90, results in the locking pins 99 being retractable, and the clasps can be opened.

The device preferably is of such size, referred to briefly above, that the supply tank 44 is of about 5 gallons capacity. This size tank is found to be about maximum size for portability and is considered to be a standard size.

What is claimed is:

1. A portable sink comprising, an assembly of components, the components including, a main case having a bottom element, surrounding side walls and an open top, an inside case having a bottom element, surrounding wall elements and an open top, a sink bowl unit, the inside case and the sink bowl unit being removably mounted in the main case, in side-by-side relation, gas pressure means in the main case, and conduit means leading from the gas pressure means to the interior of the inside case and including valve means normally closing the conduit means to the inside case, a supply tank removably mounted in the inside case, and including means responsive to the insertion of the supply tank in the inside case for opening said valve means and conducting compressed gas from the conduit means to the interior of the supply tank, the inside case including spacing means for forming a bottom space between the supply tank and the bottom element of the main case, said valve means being positioned in the bottom of the inside case and extending upwardly thereinto, and the valve opening means being mounted in the bottom of the supply tank, and the supply tank including a vertical air pipe therein leading from the valve opening means to a position adjacent the top of the supply tank.

2. A portable sink according to claim 1 wherein, the supply tank includes a vertical water delivery pipe therein leading from a position adjacent the bottom of the tank to and through the top thereof, and the water conducting means includes a water delivery conduit connected with said water delivery pipe for conducting water to a point of use.

3. A portable sink according to claim 2 wherein, the water delivery conduit includes a flexible hose and an outlet nozzle on the extended end of the flexible hose, the portable sink includes a container for supplying detergent to the outlet nozzle and thereby to the water flowing therethrough, and the outlet nozzle includes inspirator means for withdrawing detergent from its container into the water flowing through the outlet nozzle, and the outlet nozzle includes manually operable control means for controlling the flow of water therethrough and for controlling the flow of detergent into the water flowing therethrough.

4. A portable sink according to claim 3 wherein, the assembly includes a conduit interconnecting the detergent container and outlet nozzle, and the outlet nozzle and the detergent container, and the interconnecting conduit, constitute a component detachably connected with the remainder of the assembly.

5. A portable sink comprising, an assembly of components, the components including, a main case having surrounding side walls and a normally open top and also having a bottom member made up of upper and lower bottom elements at relatively different vertical locations and an intermediate wall interconnecting the bottom elements, an inside case having a bottom element, surrounding side walls and an open top and having spacing ribs on its bottom element, and also having a horizontal flange generally surrounding the open top but with terminal elements spaced apart on opposite ends of the inside case, these end elements being spaced apart forming spaces defined at their terminals by downturned tabs, the inside case being positionable in the main case, the main case having recesses in opposite side walls, the recesses opening outwardly of the main case, transversely opposite from each other, each recess having an inner wall, and surrounding bounding wall elements at the sides and bottom, and the recesses having open tops, the inside case being positionable in the main case with the tabs of the inside case extending downwardly into said recesses adjacent the surrounding bounding wall elements, the assembly also including a sink bowl unit having relatively laterally positioned sink bowls, one being deeper than the other and having a drain opening between the sink bowls, the sink unit being positionable in the main case, transversely positioned from the inside case, the sink unit including a bottom element of the deeper bowl engaging the upper bottom element in the main case and thereby supporting the sink unit in the main case, the shallower bowl extending transversely beyond said upper bottom element of the main case and defining, at the top, a space between said intermediate wall element and the inside case, the main case having a side door opening into said space, a gas pressure means detachably mounted in said space, conduit means connected between the gas pressure means and the inside case, and including a cross connector having a plurality of short conduits, conduit means leading from the gas pressure means to a first of said short conduits, and conduit means leading from another of said short conduits to the bottom of the inside case and leading therethrough and including a normally closed valve means positioned for access thereto within the inside case, a supply tank removably positioned in said inside case, and having a valve actuating element therein operable for opening said valve means in the bottom of the inside case, and also having a vertical air pipe leading from said valve means upwardly to a position adjacent to but spaced from the top of the supply tank, the conduit means, between the gas pressure means and the inside case, including branch conduits leading from respective ones of the short conduits of the cross connector, to said recesses and terminating in side wall elements of said recesses and having control pins extending into the recesses, the supply tank having elements extending into said recesses when the supply tank is in position in the inside case and having means for actuating said pins for thereby opening said valve means, the main case having an external void below the upper one of the bottom elements of the main case, a waste tank removably mountd in the void, the assembly also including a valve means forming a separate unit and positioned between said upper element and the waste tank, and including shut off means having an extension to the exterior for manual manipulation, for opening and closing a passage from the deeper sink bowl to the waste tank.

6. A portable sink according to claim 3 wherein,
the supply tank has a filling opening at the bottom confined against access thereto when the supply tank is in the inside case.

7. A portable sink according to claim 5 and including,
clasp means separate from the main case and the waste tank for detachably securing the waste tank to the main case.

8. A portable sink according to claim 5 and including,
clasp means for securing the supply tank and the inside case, in the main case, and including elements operative for actuating said pins in the conduit units, in response to moving the clasp means to securing position.

9. A portable sink according to claim 5 wherein,
the locking means includes conduits leading from the compressed air supply to predetermined points on the inside case, and locking pins exposed at the inside case, the supply tank in response to being put in place, with the air pressure supply being shut off, effecting interlocking position between the locking pins and the supply tank, and in response to the pressurized air thereafter being turned on, the air pressure effecting locking of the supply tank from removal.

* * * * *